United States Patent [19]

Snygg

[11] Patent Number: 4,749,139

[45] Date of Patent: Jun. 7, 1988

[54] APPARATUS FOR SEVERING A WEB

[75] Inventor: Keijo K. Snygg, Karhula, Finland

[73] Assignee: Valmet-Ahlstrom Inc., Karhula, Finland

[21] Appl. No.: 38,606

[22] Filed: Apr. 15, 1987

[30] Foreign Application Priority Data

Apr. 17, 1986 [FI] Finland ..... 861644

[51] Int. Cl.[4] ..... B65H 19/20; B65H 18/16

[52] U.S. Cl. ..... 242/56 R; 242/65

[58] Field of Search ..... 242/56 R, 64, 65, 74; 428/294, 295; 83/542

[56] References Cited

U.S. PATENT DOCUMENTS

| | | | |
|---|---|---|---|
| 2,461,246 | 2/1949 | Weyenberg | 83/542 X |
| 3,599,888 | 8/1971 | Coudriet et al. . | |
| 3,765,615 | 10/1973 | Brink et al. | 242/74 X |
| 3,794,255 | 2/1974 | Harmon et al. . | |
| 4,414,258 | 11/1983 | Corbin, Sr. . | |
| 4,659,029 | 4/1987 | Rodriguez | 242/56 R |

FOREIGN PATENT DOCUMENTS 1135945 12/1968 United Kingdom .

*Primary Examiner*—John M. Jillions
*Assistant Examiner*—Steven M. Dubois
*Attorney, Agent, or Firm*—Nixon & Vanderhye

[57] ABSTRACT

A web of a paper or board manufacturing machine is severed utilizing a severing tape in a fully automatic operation. A main (Pope) cylinder and reel drum are part of a winder for the web, and have a nip therebetween, the cylinder and drum mounted for rotation about parallel axes. A severing tape is attached by adhesive tape to a cardboard card mounted by a pivotal arm on a first side of the winder, with an intermediate portion of the tape held outwardly from the arm by a tape dispenser with spring clip. On the second side of the winder a swing guide is mounted for pivotal movement about an axis perpendicular to the main cylinder, and mounts a spool of tape for rotation about an axis parallel to the main cylinder. The card is inserted in the nip when web severing is desired, tape is taken up on the reel drum, and after the tape is tensioned and severs the web the tape is cut by a pair of cutting blades mounted at the second side of the winder. The operation may then be repeated for another web after attaching the severed end of the tape to another card.

19 Claims, 4 Drawing Sheets

APPARATUS FOR SEVERING A WEB

The present invention relates to an apparatus intended to be used in connection with a paper or a board manufacturing machine for severing a web by a strip while a jumbo roll is being produced.

In paper and board manufacturing, it is of primary importance that the machine can operate as uninterruptedly as possible without any stoppages. All other paper machine operations are of a continuous nature except for winding of the finished web. Breaks in the winding occur during changing of the roll and it is desirable such operation be carried out as quickly as possible so as not to waste paper and at least to avoid the need to stop the machine itself. The most difficult stage in the roll change is when the web has to be severed and winding of a new roll has to be initiated.

For this purpose, many different arrangements have been developed, starting from the operation in which, whilst the jumbo roll was being produced, a tear was struck at the edge of the web and at which tear the web would hopefully break transversely. Securing of the web around a new reel drum to permit winding was attempted by, for example, making the surface of the reel drum to some extent adhesive so as to make the free end of the web adhere to it. In many cases, however, the web started to tear longitudinally and in which case there was no alternative but to stop the machine and tear the damaged web off both the jumbo roll and the new roll.

To avoid incidents like those mentioned, a web cutting apparatus was developed to effect severing of the web across its whole width. For example, U.S. Pat. No. 3,794,255 discloses the utilization a toothed blade in web cutting. The apparatus is also equipped with a specific web guide which, at the cutting stage raises the web off the surface of a guide roller, at the same time constituting a counterpiece of the cutting blade to ensure the cutting. In this solution, securement prior to winding of the web around the new reel drum was effected by applying a glue-like layer on the surface of the reel drum, to which layer the free end of the web is bound to adhere. FI-Pat. Nos. 69819 and 69820 disclose equivalent cutting solutions.

U.S. Pat. No. 3,599,888 discloses a use of an adhesive tape in web cutting, wherein the web is arranged to extend diagonally across the web and the ends of the adhesive tape extend beyond the edges of the web. When the web is led in between the new roll and a rotating roller, which roller also leads the web to the jumbo roll, the ends of the adhesive tape will adhere firmly to the new roll. While being held firmly against the new roll by the adhesive tape and tending to follow the rotating roller, the web is cut along the edge of the adhesive tape. Furthermore, another tape is arranged beside said adhesive tape and at the leading end of it and partly on top of the first adhesive tape, so that said another tape does not extend beyond the edges of the web. It can thereby be ensured that the trailing end of the web on the completed jumbo roll will also adhere to the preceding layer of the web so that there is no danger of the top layers of the jumbo roll becoming slack. The patent also discloses the manual disposing of an adhesive tape in place on the web with the machine being either in operation or stopped. The patent furthermore discloses the possibility of arranging for a separate roll to feed the adhesive tape to a desired place on the web in the winding station. Due to the present high machine speeds, the first two manual methods as presented hereinabove are impractical, and even the third method is highly uncertain with such high speed operation. Anyway, it has to be said that the mechanical method as presented would call for extensive equipment in the winding station which in any event is of very restricted space. The equipment would also be very costly.

Another type of tape cutting is presented in GB-Pat. No. 1135945 wherein a web is severed by means of a strip tensioned against the surface of a new roll. Initially, one end of the tape is fixed with a loop on the shaft of an empty reel drum and led through a spring tab ahead of the rolls and below the web, when viewed downstream relative to web movement. The other end of the tape is led through two supports to a rotating wheel the speed of which can be reduced. At this state, the web runs between the rotating roll and an empty reel drum above it to a jumbo roll which is substantially on the same level horizontally as the rotating roll and disposed behind it. As soon as the jumbo roll has been wound to its full diameter, the tape will be tensioned so as to loosen it from the spring tab and force it in between the rotating roll and the empty reel drum. Since the tape has been attached to the shaft of the reel drum and its other end to the deceleratable wheel, it tends to follow the surface of the reel drum, thus cutting the web which tends to follow the rotating roll downwards. Even though the apparatus functions satisfactorily and is simple, it also has some shortcomings. For example, the taking of a tape loop to the shaft of an empty reel drum is sometimes a difficult and even dangerous task because it has to be done near fastrotating rolls. The manual tape launching mechanism disclosed in this prior specification case is also inaccurate and calls for continuous follow-up of the jumbo roll.

U.S. Pat. No. 4,414,258 relates to a turn-up tape used for severing a travelling web of paper. A tape spool is arranged on one side of the winder section of the paper machine. The tape is taken to the other side of the machine, and the end of the tape on the reel drum side is made adhesive and then fed in between the Pope cylinder and reel drum, whereby one end of the tape adheres to the reel drum and freely winds around the drum, at the same time cutting the web due to tensioning of said tape. The tape spool has a braking device which maintains a sufficient tension in the tape for cutting the web. In the U.S. Pat. No. 4,414,258, there is no discussion as to how the end of the tape is inserted into the nip between the Pope cylinder and the reel drum. Thus, it is assumed likely such is inserted manually, which is very dangerous as one has to stand close to fast-rolling cylinders and rolls whilst feeding the tape into a small nip.

It is an object of the present invention, to provide an apparatus which eliminates or minimises the disadvantages and dangers of the above-mentioned apparatuses. The apparatus according to the invention is characterized in that it comprises a tape feeding device articulated to one side of the winder, said feed device being operable to feed the tape in between the Pope cylinder and reel drum, a stationary guide or swing guide articulated to the opposite side of the winder, said guide guiding the winding of the tape around the reel drum, and a tape cutting apparatus which cuts the tape after said tape having severed the web. An advantage of the working principle of the apparatus according to the invention is its nearly automatic operation. The operator needs only to set the apparatus after each roll change whereafter it takes care of the web cutting on its own in due time. Other advantages are, for example, that the apparatus is easy to set and has a construction that is simple and reliable in operation.

The invention will be described further, by way of example, with reference to the accompanying drawings, in which FIG. 1 is a schematic side view of one half of a severing apparatus according to the invention;

Figure 1:
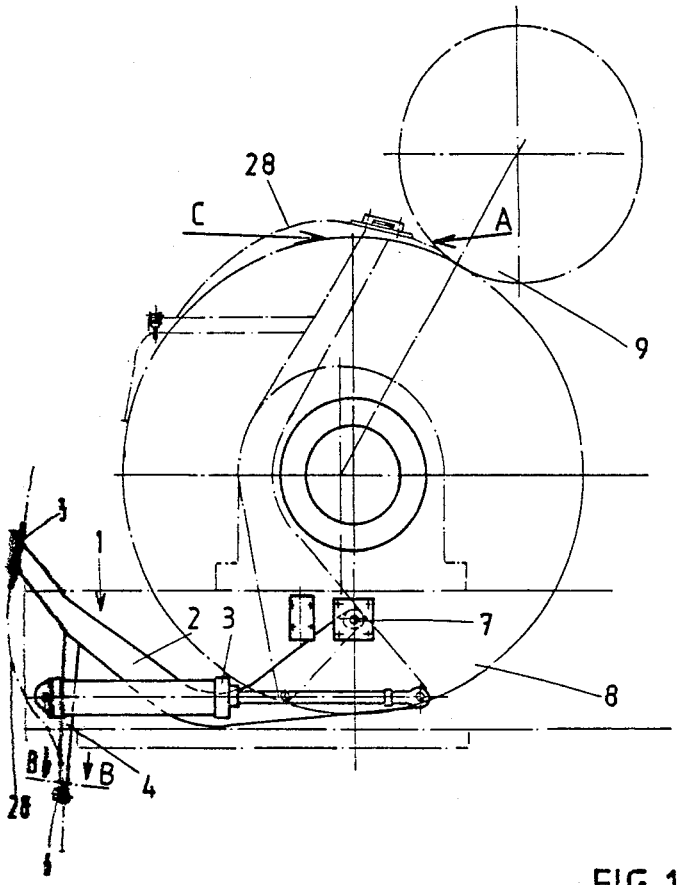

FIG. 1 is schematic illustration of a winder of a paper or board manufacturing machine, which winder receives web, entering from the left-hand side i.e. from the direction of arrow C. FIG. 1 shows the position in which reel drum 9 has been lowered and brought into contact with Pope cylinder 8 whereupon the Pope cylinder 8 makes the reel drum 9 rotate the web remaining between the drum 9 and cylinder 8. A tape feeder 1 in the tape cutting device of the invention mainly comprises a turning arm 2 having drive device 3 (piston-cylinder), a tape holder 4, a card holder 5 at the end of the turning arm 2, with a spring clip 6 being mounted at the end of said tape holder 4. The turning arm 2 is articulated to one side of the winder and arranged so as to turn in the same direction as the machine. To the same side of the winder, drive device 3 is also articulated and one end thereof (end of the piston rod) is articulated to the turning arm 2 so as to permit the turning of the turning arm 2 from a substantially horizontal position (as shown in full-line) to a substantially vertical position (as shown in broken line). At a distance from the free end of the turning arm 2 there is secured thereto the tape holder 4 having one end of which i.e. spring clip 6 remaining somewhat below the card holder 5, when the turning arm is in the vertical position. The card holder 5 is disposed at the end of the turning arm 2. As also shown in FIG. 1, the articulation point 7 of the turning arm 2 in this embodiment is disposed on that vertical plane which extends through the shaft (axis) of the Pope cylinder 8 and at a distance below the shaft. The efficient length of the turning arm 2 is such that the card holder 5 extends a little above the shell of the Pope cylinder 8 when the turning arm 2 is in its vertical position. In this case the spring clip 6 remains somewhat below the upper horizontal plane tangential to the Pope cylinder shell.

Figure 2:
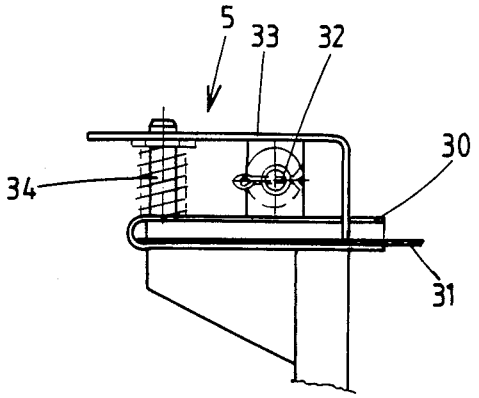
FIG. 2 is a schematic view in the direction of arrow A in FIG. 1 illustrating a preferred embodiment of a card holder used in the apparatus.

FIG. 2 illustrates the structure of the card holder 5 which is located at the end of the turning arm 2. Card holder 5 comprises a pocket 30 made of bent plate material, said pocket being open in the moving direction of the web and towards the inside of the machine so as to make it possible to insert a card 31 made of, for instance, cardboard in the pocket in a way such that two sides of the card remain totally outside the holder, cf. FIG. 4. The disposition of the holder 5 when the turning arm 2 is in the vertical position, is substantially such that the card 31 in the holder 5 projects in-between the Pope cylinder 8 and the reel drum 9. The card 31 may be inserted in the pocket 30 of the holder 5 by a lever 33, mounted on bearings on a shaft 32, being pressed at one end i.e. the one on the side of the spring 34, whereby the opposite end of the lever 33 is detached from the lower side of the pocket 30 to permit the card 31 to be pushed into the pocket 30 below the lever 33.

Figure 3:
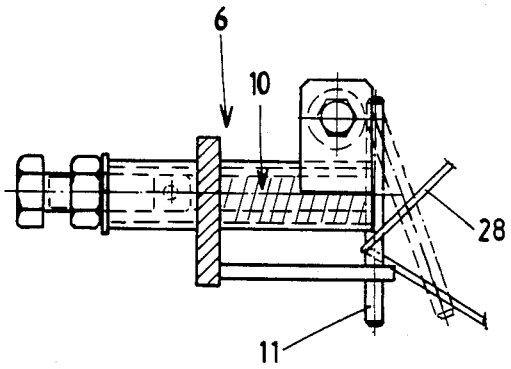
FIG. 3 is a sectional view taken along line B—B of FIG. 1, illustrating a preferred embodiment of a tape holder used in the apparatus.

FIG. 3 illustrates the spring clip 6 located at the end of the tape holder 4, said clip 6 comprising a lever 11 biased by a spring 10, which construction forms a loop for a tape 28 to travel in. While the tape is being stretched, the spring 10 lengthens and opens a route for the tape to slip off the clip 6.

Figure 4:
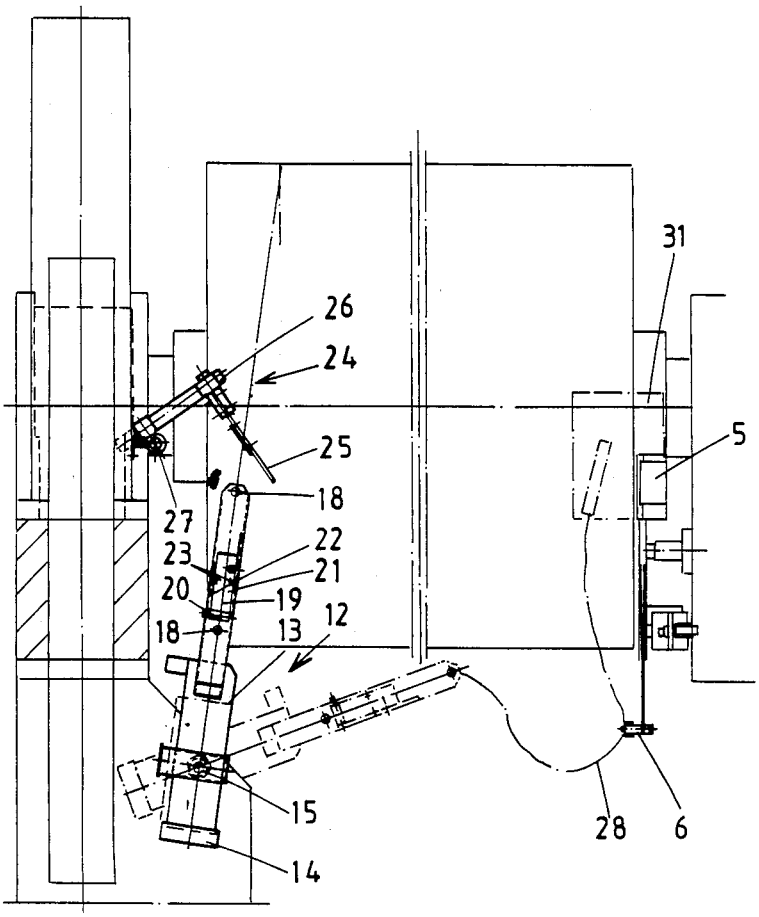
FIG. 4 is a schematic illustration of a preferred embodiment of a swing guide and tape cutting device used in the apparatus and viewed downstream of the machine.
Figure 5:
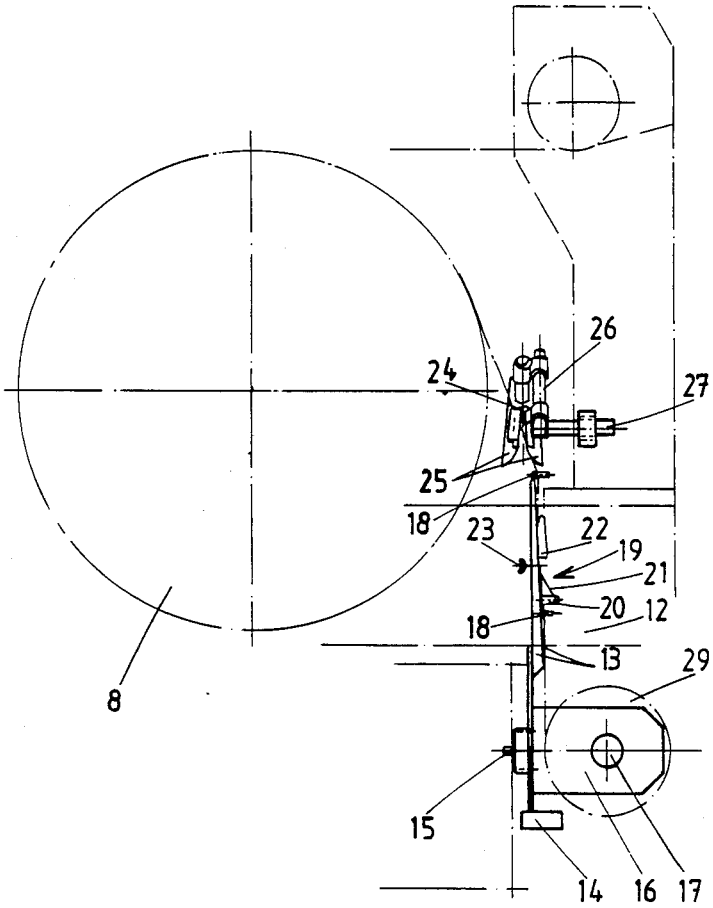
FIG. 5 is a side view of the device of FIG. 4 viewed from the left-hand side thereof.

FIG. 4 presents the parts of the tape cutting device that are disposed on the other side of the winder i.e. a swing guide 12 swinging vertically across the direction of movement of the web and a tape cutting device 24. The swing guide 12 comprises a lengthy frame part 13, at the lower end of which is disposed a counterweight 14 to balance the guide. The swing guide 12 is articulated at point 15 to the winder frame so as to enable it to pivot between the substantially vertical position and the inwards directed horizontal position of the winder in the direction of the Pope cylinder shaft. Turning of the swing guide is so balanced that, upon becoming tensioned, the tape 28 is able to turn the guide. On the opposite side of frame 13 to the articulation and secured to the guide 12 at the end of an arm 16, there is a shaft 17 on which a tape spool 29 is disposed (FIG. 5). The upper part of the frame part 13 is also equipped with guide loops 18 for the tape and a strip brake 19 between the loops, which brake comprises a bent plate 21, said plate being mounted on bearings on lugs 20 and disposed at a distance from the frame part 13, and having on its middle area a part 22 substantially parallel with the frame part 13, the tape travelling between said part 22 and frame part 13. A braking effect is accomplished by two spring-loaded adjustable screws 23 which press the part 22 against the frame part 13.

FIG. 5 illustrates a tape cutting device 24 which, just like the swing guide 12, is disposed extending against the direction of movement of the web and a little before the Pope cylinder 8. The tape cutting device 24 is adjustably attached to the winder frame so as to leave the cutting blade a little outside of the vertical plane extending through the edge of the web. The cutting device 24 mainly comprises two cutting blades 25 positioned in the V-formation in relation to each other, said blades being secured to a rod 26 so that they can be turned and being adjustable in the longitudinal direction of said rod; said rod being correspondingly secured to a horizontal rod 27 extending in the machine direction and turnably or pivotally attached to the reel frame.

The working principle of the apparatus in accordance with the invention utilising the severing of a web by a tape, involves the following: The tape 28 unwinding from a tape spool 29 disposed on the shaft 17 is threaded through the guide loops 18 and the strip brake 19 positioned between said loops. Thereafter, the tape is taken from the swing guide 12 under the paper web to the other side of the winder and then threaded through a loop of the spring clip 6 towards the card holder 5. Next, the tape is pressed by means of an appropriate card and two-sided adhesive tape on the piece of cardboard so that the tape remains between the adhesive tape and the cardboard, and the tape with adhesive tape remains, when seen downstream, in the left corner of the card with its glue side upwards. In a position like this, the card is taken to the card holder 5, and consequently the tape runs direct from the card to the loop of the spring clip 6. At this stage, as the turning arm 2 is in its bottom position i.e. substantially horizontal, the device is ready for operation.

The operation itself takes place as follows. As the paper roll being wound on the reel drum reaches its full diameter, the drive device 3, which is most usually a pneumatic or a hydraulic cylinder, receives an impulse causing it to operate and consequently turn the turning arm 2 to the upper position and thus pushing the end of the card 31 disposed in the card holder 5 in between the reel drum 9 and the Pope cylinder 8 on the shell area adjacent to the web. The rotating rolls draw the card in between them, whereby the upper surface of the adhesive tape adheres to the reel drum, thus drawing the tape with it. At this stage, the tape becomes stretched and is pulled loose of the spring clip 6 of the tape holder 4, whereby the tape will be free to be wound almost a complete revolution around the reel drum until it is stretched to such an extent in the cross direction of the winder as to break the web in a controlled manner. The tension of the tape can be adjusted to suit every situation of the operation by means of the swing guide brake. While severing the web, the tape leads the free end of the web around the reel drum. As soon as the tape has spirally wound around the reel drum and cut the web across its entire width, it has travelled so far to the left (FIG. 4) that it is drawn in between the blades of the tape cutting device 24, which blades cut it off. In this case the brake 19 holds the end of the tape in place so as to make it easy to draw said tape from that position under the web and to reset and reoperate the device.

At this stage, it is worth mentioning that the device as such is suitable for cutting webs of all widths. Should there be a need for adjustment, the tape cutting device 24 is fully adjustable, to suit, for instance, a considerably narrower web, so as to thereby save tape. It is also worth mentioning that the balancing of the swing guide 12 ensures the best possible way of winding the tape around the reel drum.

Further, it is worth mentioning that, the above description discloses only one favourable embodiment of the apparatus of the invention, which is not intended to in any way limit the invention from what is presented in the accompanying patent claims. Hence, it is completely possible to make the end of the tape adhesive in some other way. The use of the card as specified hereinabove is one reliable and approved way. If the card is, however, not used, the structure of the card holder 5 will change considerably. It is also possible to further simplify the device by replacing the swing guide by a simple, stationary guide roller or equivalent which leads the tape unwinding from the spool to the feeding device. The most suitable way of providing the stationary guide is to dispose it below the tape cutting device in a way that when the tape is being wound around the reel drum, it gets in between the blades of the cutting device. Also other equivalent changes are possible without departing from the concept and scope of the invention as claimed.

I claim:

1. Apparatus for severing a web being wound by a web winder of a web manufacturing machine, the web winder including a main cylinder and a reel drum, having a nip therebetween, mounted for rotation about parallel axes, said apparatus comprising:

a severing tape capable of severing the web being wound by said winder;

automatic tape feed means movably mounted on a first side of said winder, for automatically feeding said tape in between said main cylinder and said reel drum on said first side automatic guide means mounted on a second side of said winder, opposite said first side, for automatically controlling spiralled threading of said tape around said reel drum from said first side to said second side; and automatic tape cutting means on said second side for automatically engaging and cutting said tape after it has severed a web being wound by said web winder.

2. Apparatus as recited in claim 1 wherein said tape feed means comprises: a locating arm mounted on said first side of said winder adjacent said main cylinder for movement with respect to the axis of rotation of said main cylinder, said locating arm having a card holder mounted at a free end thereof; a tape dispensing holder mounted to said locating arm spaced from said card holder; and power drive means for moving said locating arm with respect to the axis of rotation of said main cylinder so that said card holder is movable from a position spaced from said main cylinder and reel drum to a position in which it feeds tape in between said main cylinder and said reel drum.

3. Apparatus as recited in claim 2 wherein said locating arm is mounted for pivotal movement between said first and second positions thereof about an axis generally parallel to the axis of rotation of said main cylinder.

4. Apparatus as recited in claim 3 wherein said guide means comprises a swing guide comprising an elongated frame part mounted on said second side of said winder for rotation about an axis generally prependicular to the axis of rotation of said main cylinder; said frame part including a strip brake and a tape spool, said tape spool having a supply of said tape thereon and rotatable about a shaft which extends generally parallel to the axis of said main cylinder, tape extending from said tape spool along said frame part being generally parallel to said frame part.

5. Apparatus as recited in claim 4 wherein said tape cutting means comprises a pair of cutting blades adjustably mounted on said second side of said winder, said blades disposed in a V-shape configuration with the open part of the V extending toward said tape.

6. Apparatus as recited in claim 5 wherein said frame part is mounted for rotation between a first position in which said tape is loose, to a second position in which said tape is completely taut and has been spirally wound around said reel drum; said tape cutting device mounted adjacent said second position of said frame part to receive said tape between said cutting blades when said frame part is in said second position.

7. Apparatus as recited in claim 2 wherein said card holder comprises a pocket made of plate material, said pocket dimensioned and constructed to maintain a card in place therein; said severing tape adhering to said card.

8. Apparatus as recited in claim 7 wherein said card is of cardboard, and wherein said severing tape is adhered to said card by adhesive tape.

9. Apparatus as recited in claim 7 wherein said tape holder is provided at an end thereof remote from said locating arm with a spring clip; said spring clip comprising means for guiding said tape to a desired position with respect to the web, prior to severing, and for releasing the tape as the tape becomes tensioned so that the tape may be wound around said reel drum.

10. Apparatus as recited in claim 2 wherein said tape holder is provided at an end thereof remote from said locating arm with a spring clip; said spring clip comprising means for guiding said tape to a desired position with respect to the web, prior to severing, and for releasing the tape as the tape becomes tensioned so that the tape may be wound around said reel drum.

11. Apparatus as recited in claim 1 wherein said guide means comprises a swing guide comprising an elongated frame part mounted on said second side of said winder for rotation about an axis generally perpendicular to the axis of rotation of said main cylinder; said frame part including a strip brake and a tape spool, said tape spool having a supply of said tape thereon and rotatable about a shaft which extends generally parallel to the axis of said main cylinder, tape extending from said tape spool along said frame part being generally parallel to said frame part.

12. Apparatus as recited in claim 11 wherein said tape cutting means comprises a pair of cutting blades adjustably mounted on said second side of said winder, said blades disposed in a V-shape configuration with the open part of the V extending toward said tape.

13. Apparatus as recited in claim 12 wherein said frame part is mounted for rotation between a first position in which said tape is loose, to a second position in which said tape is completely taut and has been spirally wound around said reel drum; said tape cutting device mounted adjacent said second position of said frame part to receive said tape between said cutting blades when said frame part is in said second position.

14. Apparatus as recited in claim 1 wherein said tape cutting means comprises a pair of cutting blades adjustably mounted on said second side of said winder, said blades disposed in a V-shape configuration with the open part of the V extending toward said tape.

15. Apparatus for severing a web being wound by a web winder of a web manufacturing machine, comprising:

a severing tape capable of severing the web being wound by the web winder when the severing tape is taut;

said winder comprising a main cylinder and a reel drum, having a nip therebetween, and rotatable about parallel axes;

a locating arm pivotally mounted on a first side of said winder near said main cylinder, and pivotal about an axis generally parallel to the axis of rotation of said main cylinder; said locating arm comprising a tape feed device, including a card holder mounted at a first end of said arm and holding a card, to which said severing tape is attached, therein; said arm mounted for pivotal movement between a first position wherein said tape is loose and is spaced from said main cylinder and said reel drum, to a second position in which said card, with said tape attached thereto, is fed in between said main cylinder and said reel drum so that said reel drum may take up said tape and tension it; and guide means mounted on a second side of said winder, opposite from said first side, for controlling threading of said tape around said reel drum.

16. Apparatus as recited in claim 15 wherein said card is of cardboard, and wherein said severing tape is adhered to said card by adhesive tape.

17. Apparatus is recited in claim 15 further comprising a tape dispensing holder mounted on said locating arm spaced from said card holder, said tape dispensing holder including a spring clip which guides said tape to the desired side of the web being cut when the tape is loose, and releases said severing tape as said tape becomes tensioned.

18. A method of severing a paper or board web being wound by a web winder includng a main cylinder and a reel drum, having a nip therebetween, utilizing a severing tape, comprising the steps of:

attaching a free end of the severing tape to a card;

mounting the card for movement into a position between the main cylinder and reel drum on a first side of the winder;

mounting a spooled supply of tape on a second side of the winder, opposite the first side;

when web severing is desired, then:

automatically moving the card into a position between the main cylinder and the reel drum at the first side of the winder, so that the reel drum starts to take up the severing tape;

automatically guiding the severing tape so that it may be taken up by the reel drum and spirally wound therearound so that the severing tape is pulled taut and when completely taut severs the web in the cross-direction of the winder; and after complete tensioning of the severing tape, automatically cutting the tape by engagement of the tape with a cutting means at the second side of the winder so that the web severing operation is completed and the severing tape may be attached to another card and the process automatically repeated for other webs to be severed.

19. Apparatus for severing a web being wound by a web winder of a web manufacturing machine, the web winder including a main cylinder and a reel drum, having a nip therebetween, mounted for rotation about parallel axes, said apparatus comprising:

a severing tape capable of severing the web being wound by said winder;

tape feed means movably mounted on a first side of said winder, for feeding said tape in between said main cylinder and said reel drum;

guide means mounted on a second side of said winder, opposite said first side, for controlling threading of said tape around said reel drum; and tape cutting means for engaging and cutting said tape after it has severed a web being wound by said web winder, comprising a pair of cutting blades adjustably mounted on said second side of said winder, said blades disposed in a V-shape configuration with the open part of the V extending toward said tape.

* * * * *